US008879363B2

(12) United States Patent
Yonekura

(10) Patent No.: US 8,879,363 B2
(45) Date of Patent: Nov. 4, 2014

(54) ELECTRONIC TIMEPIECE

(75) Inventor: Takaomi Yonekura, Akiruno (JP)

(73) Assignee: Casio Computer Co., Ltd., Tokyo (JP)

( * ) Notice: Subject to any disclaimer, the term of this patent is extended or adjusted under 35 U.S.C. 154(b) by 87 days.

(21) Appl. No.: 13/602,478

(22) Filed: Sep. 4, 2012

(65) Prior Publication Data

US 2013/0058197 A1 Mar. 7, 2013

(30) Foreign Application Priority Data

Sep. 7, 2011 (JP) ..... 2011-194529

(51) Int. Cl.

| | |
|---|---|
| ***G04B 47/00*** | (2006.01) |
| ***G04C 3/00*** | (2006.01) |
| ***G04G 21/04*** | (2013.01) |
| ***G04G 21/02*** | (2010.01) |
| ***G04G 19/12*** | (2006.01) |

(52) U.S. Cl.

CPC ..... *G04G 19/12* (2013.01); *G04C 3/002* (2013.01); *G04G 21/04* (2013.01); *G04G 21/02* (2013.01)

USPC ..... 368/10; 368/204; 702/141; 702/154; 340/669; 340/689

(58) Field of Classification Search

CPC ..... G04G 19/12; G04G 21/02; G04F 3/0346; H04W 52/0274

USPC ..... 368/9–11, 204; 702/141, 154; 340/669, 340/689

See application file for complete search history.

(56) References Cited

U.S. PATENT DOCUMENTS

| | | | | |
|---|---|---|---|---|
| 3,939,640 | A * | 2/1976 | Kahn | 368/28 |
| 6,477,117 | B1 * | 11/2002 | Narayanaswami et al. | 368/251 |
| 2007/0102525 | A1 * | 5/2007 | Orr et al. | 235/472.01 |
| 2007/0150229 | A1 | 6/2007 | Fujiwara | |
| 2008/0117060 | A1 * | 5/2008 | Cuddihy et al. | 340/573.1 |
| 2009/0164219 | A1 * | 6/2009 | Yeung et al. | 704/258 |
| 2009/0316532 | A1 * | 12/2009 | Hasegawa | 368/1 |
| 2011/0040803 | A1 * | 2/2011 | Pasquero et al. | 707/803 |
| 2011/0059769 | A1 * | 3/2011 | Brunolli | 455/556.1 |
| 2012/0082013 | A1 * | 4/2012 | Yeung et al. | 368/274 |

FOREIGN PATENT DOCUMENTS

JP 2007-178303 A 7/2007

* cited by examiner

*Primary Examiner* — Amy Cohen Johnson
*Assistant Examiner* — Matthew Powell
(74) *Attorney, Agent, or Firm* — Holtz, Holtz, Goodman & Chick PC

(57) ABSTRACT

An electronic timepiece includes a display unit, a communication unit, a tilt detector, an acceleration detector, and a power-off unit. The display unit displays information including information of time. The communication unit performs near field communication with an external device via an antenna. The tilt detector detects a tilting movement of a main body of the electronic timepiece. The acceleration detector detects an accelerated movement of the main body. The power-off unit turns off a power of the communication unit when the tilt detector does not detect the tilting movement and when the acceleration detector does not detect the accelerated movement.

10 Claims, 7 Drawing Sheets

ELECTRONIC TIMEPIECE

BACKGROUND OF THE INVENTION

1. Field of the Invention

The present invention relates to an electronic timepiece that performs near field communication with an external device.

2. Description of Related Art

With the development of low-power technique for the near field communication using Bluetooth®, for example, there has been a technique in which an electronic timepiece and a cellular phone, such as a smart phone, as an external device are connected and communicate with each other almost constantly to perform various communications with each other. For example, the smart phone can transmit time data to the electronic timepiece. As another example, the smart phone can send information of arrival of an e-mail or a call to the electronic timepiece, and a ringer tone or message alert tone and/or vibration of the smart phone can be stopped upon a user operation of the electronic timepiece when the smart phone is ringing.

In the case of an electronic timepiece that is almost-constantly connected with a cellular phone such as a smart phone using the near field communication technology, it is desired that a built-in button primary battery last for a few years as in the case of general wristwatches. When the electronic timepiece is almost-constantly connected with a smart phone with the Bluetooth®, for example, the battery life is profoundly affected by an operating current of a Bluetooth® module which performs transmission and reception. Accordingly, in order to keep the almost-constant connection for a user while extending the battery life, it is required that the power of the Bluetooth® module be frequently turned on and off to reduce accumulated power-on time of the Bluetooth® module as much as possible.

Japanese Unexamined Patent Application Publication No. 2007-178303 discloses an electronic pedometer having an acceleration sensor and a tilt sensor. In this electronic pedometer, when the tilt sensor determines that the pedometer is inclining, the acceleration sensor counts the number of steps.

A user who wears an electronic timepiece, however, makes various movements other than walking and running. When the electronic timepiece is almost at rest, e.g., when the user crosses his or her arms in a meeting or on the train, or when the user is driving on an express highway, for example, the movement of the electronic timepiece cannot be fully detected. As a result, the power of the Bluetooth® module is turned off in such situations, which causes the following problems.

In the past, an electronic timepiece has been used mainly for a clock function. The electronic timepiece, therefore, has been checked only when a user needs to know the time. Accordingly, in the case of a conventional timepiece, when the user needs to know the time, the user has only to cancel the time-display-off mode by moving his or her arm, for example, to display the time again. A constantly-connected timepiece, however, cannot receive information of incoming phone calls or e-mails from the smart phone when the power of the Bluetooth® module is off. Even if a user turns on the power by moving his or her arm later, the information of incoming phone calls or e-mails during the power-off period cannot be received. Therefore, in the case where the electronic timepiece is almost-constantly connected with the smart phone with the Bluetooth®, a more precise movement-detection technology and a better power-saving technology are required.

SUMMARY OF THE INVENTION

The present invention provides an electronic timepiece that performs near field communication with an external device, and that turns on or off the power of a communication unit at an appropriate timing to achieve both reliable near field communication and power saving.

According to an aspect of the present invention, there is provided an electronic timepiece including: a display unit that displays information including information of time; a communication unit that performs near field communication with an external device via an antenna; a tilt detector to detect a tilting movement of a main body of the electronic timepiece; an acceleration detector to detect an accelerated movement of the main body; and a power-off unit that turns off a power of the communication unit when the tilt detector does not detect the tilting movement and when the acceleration detector does not detect the accelerated movement.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

An embodiment of the present invention is described below with reference to the attached drawings.

Figure 1:
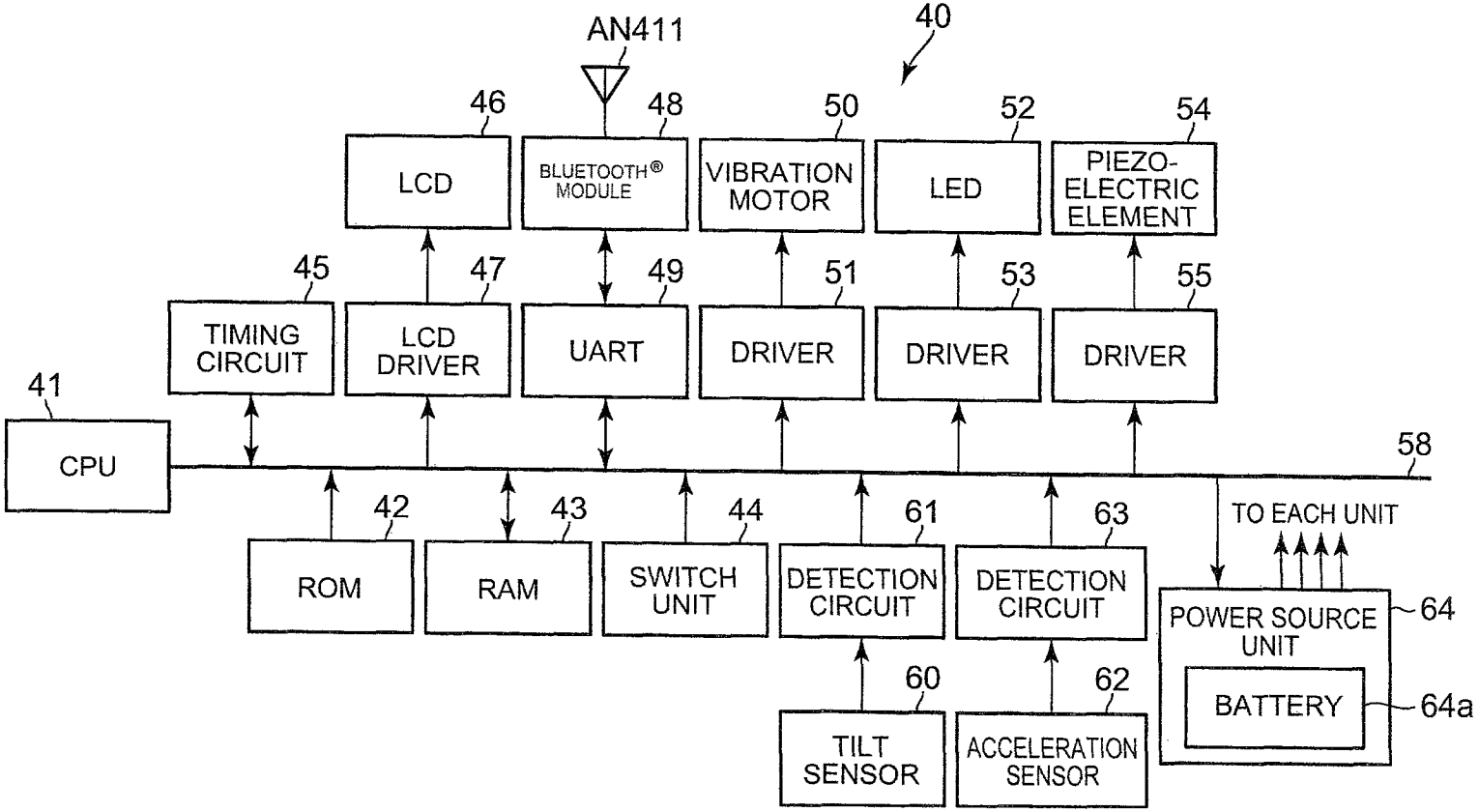
FIG. 1 is a block diagram illustrating an internal configuration of an electronic timepiece 40 according to an embodiment of the present invention.
Figure 2:
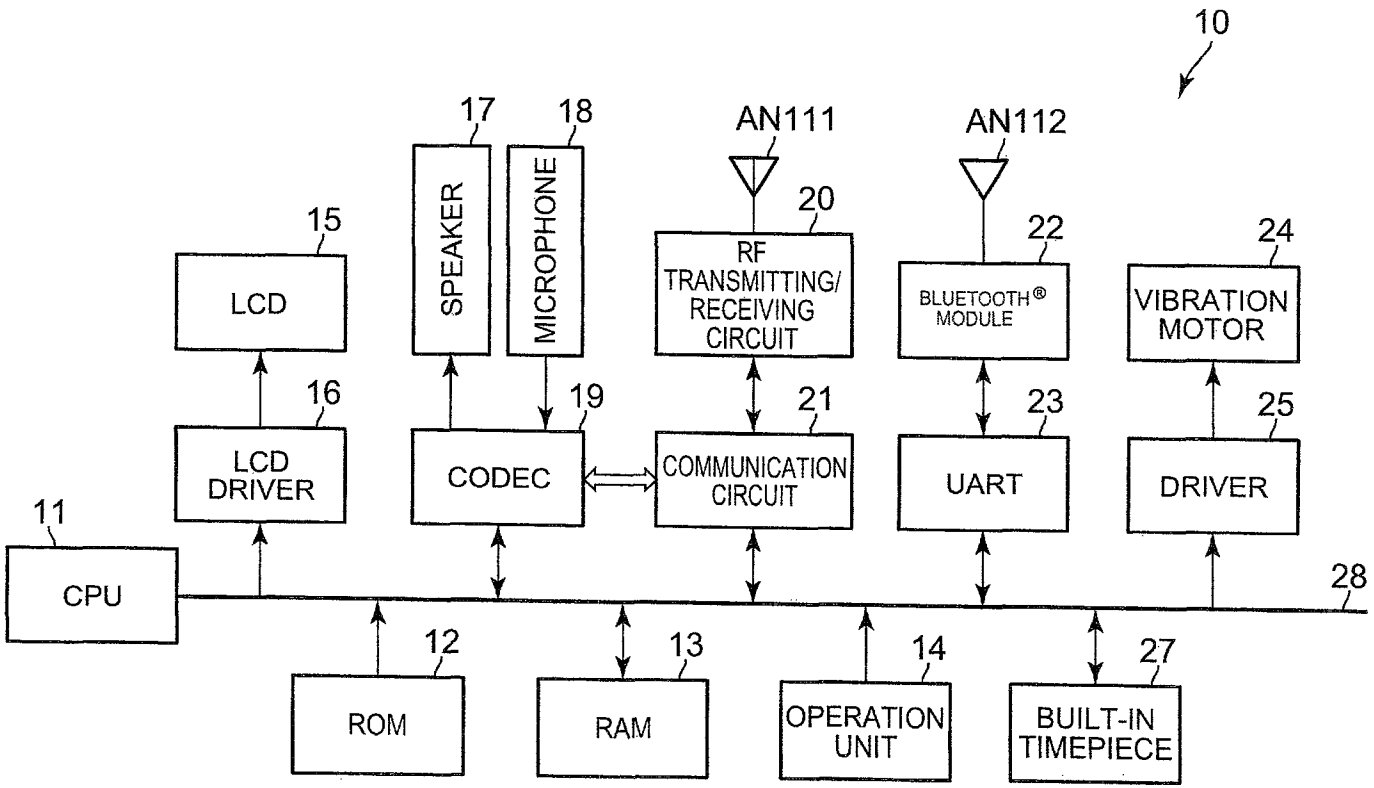
FIG. 2 is a block diagram illustrating an internal configuration of a smart phone 10 to be connected with the electronic timepiece 40 according to the embodiment of the present invention.

FIG. 1 is a block diagram illustrating an internal configuration of an electronic timepiece 40 according to the embodiment of the present invention. FIG. 2 is a block diagram illustrating an internal configuration of a smart phone 10 to be connected, as an external device, with the electronic timepiece 40 according to the embodiment of the present invention.

As shown in FIG. 1, the electronic timepiece 40 includes a CPU (central processing unit) 41, a ROM (read only memory) 42, a RAM (random access memory) 43, a switch unit 44, a timing circuit 45, an LCD (liquid crystal display) 46, and an LCD driver 47. The CPU 41 performs an overall control of the electronic timepiece 40. The ROM 42 stores control programs and control data to be executed by the CPU 41. The RAM 43 provides a work memory space for the CPU 41. The switch unit 44 includes an externally-operable switch for switching a mode and a plurality of externally-operable switches for making a setting for time. The timing circuit 45 serves as a timing unit for keeping time. The LCD 46 serves as a display unit that is provided at the center of the main body of the electronic timepiece 40 and that provides a time display and a display for various functions. The LCD driver 47 drives the LCD 46. The electronic timepiece 40 also includes a Bluetooth® module 48 (near field communication module), a UART (Universal Asynchronous Receiver Transmitter) 49, a vibration motor 50, a driver 51 for the vibration motor 50, an LED (light-emitting diode) 52, a driver 53 for the LED 52, a piezoelectric element 54, and a driver 55 for the piezoelectric element 54. The Bluetooth® module 48 serves as a communication unit that performs near field communication via an antenna AN 411. The UART 49 performs data processing, such as a serial-parallel conversion, for the data transmitted/received via the Bluetooth® module 48. The vibration motor 50 gives notifications to a user through vibration alert. The LED 52 gives notifications to a user by emitting or blinking light, or illuminates the face of the electronic timepiece 40. The piezoelectric element 54 gives notifications to a user by emitting a sound. The electronic timepiece 40 also includes a tilt sensor 60, a detection circuit 61 for the tilt sensor 60, an acceleration sensor 62, a detection circuit 63 for the acceleration sensor 62, a power source unit 64, and a bus 58. The tilt sensor 60 detects a tilting movement of the electronic timepiece 40. The acceleration sensor 62 detects an accelerated movement of the electronic timepiece 40. The power source unit 64 contains a battery 64*a* therein and supplies an operating voltage to each unit. The bus 58 is a section through which the CPU 41 and each unit transmit/receive signals with each other.

The Bluetooth® module of the present embodiment is also called a Bluetooth® RF chip or a Bluetooth® transmitting/receiving unit. In general, when the term "module" is used, the module often includes an application or an OS to perform control. On the other hand, when the term "chip" is used, an application or an OS to control the chip is often provided separately from the chip. In the present embodiment, the term "Bluetooth® module" indicates a section of the Bluetooth® that has the function to perform transmission/reception and that consumes a large amount of power. In this sense, the Bluetooth® RF chip, the Bluetooth® transmitting/receiving unit, and a radio receiving unit each have the same meaning as the Bluetooth® module.

The ROM 42 of the electronic timepiece 40 stores programs for a basic timepiece mode process, an operation input process, a paring process, and an associating process as the control programs. The basic timepiece mode process is a process to display the time or to activate an alarm at a set time according to the timing data of the timing circuit 45. The operation input process is a process to change an operation mode or to make various settings in response to an input through the switch unit 44. The paring process is a process to be performed in response to a paring operation by user. The associating process is a process to associate the electronic timepiece 40 and the smart phone 10 with each other in various ways.

As shown in FIG. 2, the smart phone 10 includes a CPU 11, a ROM 12, a RAM 13, an operation unit 14, an LCD (liquid crystal display) 15, an LCD driver 16, a speaker 17, a microphone 18, a codec 19, an RF transmitting/receiving circuit 20, and a communication circuit 21. The CPU 11 performs an overall control of the smart phone 10. The ROM 12 stores control programs and control data to be executed by the CPU 11. The RAM 13 provides a work memory space for the CPU 11. The operation unit 14 includes a plurality of operation keys. The LCD 15 provides a display for various functions. The LCD driver 16 drives the LCD 15. The speaker 17 and the microphone 18 allow sound output and sound input, respectively, when a user is talking on the phone. The codec 19 converts inputted sound signals into digital data and converts digital data into sound signals to be outputted. The RF transmitting/receiving circuit 20 transmits/receives wireless signals to/from a base station via an antenna AN 111. The communication circuit 21 modulates and demodulates digital data of sound inputted/outputted from/to the codec 19 and various transmitted or received data. The smart phone 10 also includes a Bluetooth® module 22, a UART 23, a vibration motor 24, a driver 25 for the vibration motor 24, a built-in timepiece 27, and a bus 28. The Bluetooth® module 22 performs near field communication via an antenna AN 112. The UART 23 performs data processing, such as a serial-parallel conversion, for the data transmitted/received via the Bluetooth® module 22. The vibration motor 24 notifies a user of incoming phone calls or e-mails through vibration alert. The built-in timepiece 27 keeps time. The bus 28 is a section through which the CPU 11 and each unit transmit/receive signals with each other.

Next, the operation of the electronic timepiece 40 is described below.

Figure 3:
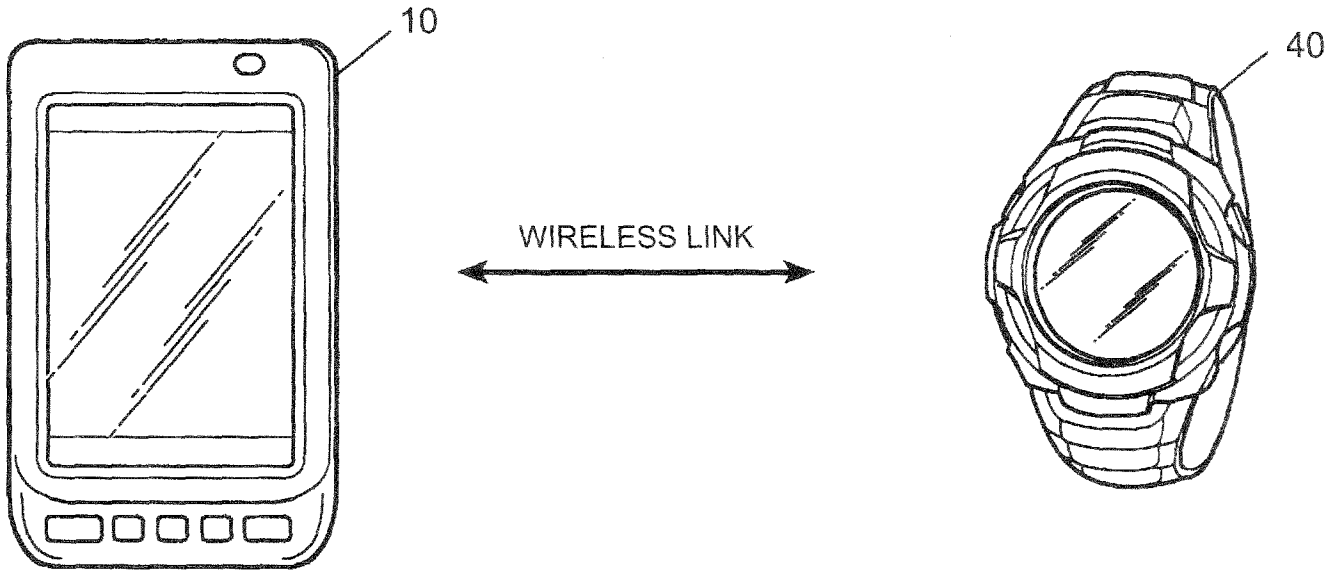
FIG. 3 illustrates the electronic timepiece 40 according to the embodiment of the present invention being connected with the smart phone 10 via wireless link.
Figure 4:
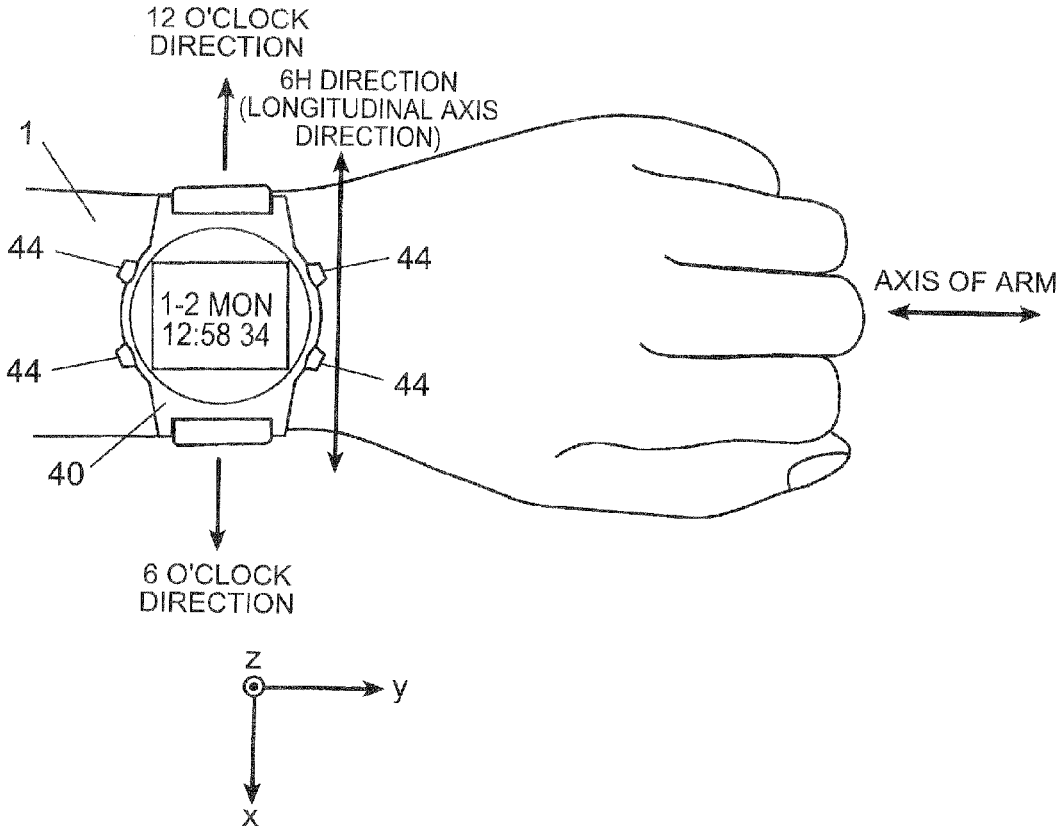
FIG. 4 illustrates the electronic timepiece 40 on a user's arm.
Figure 5:
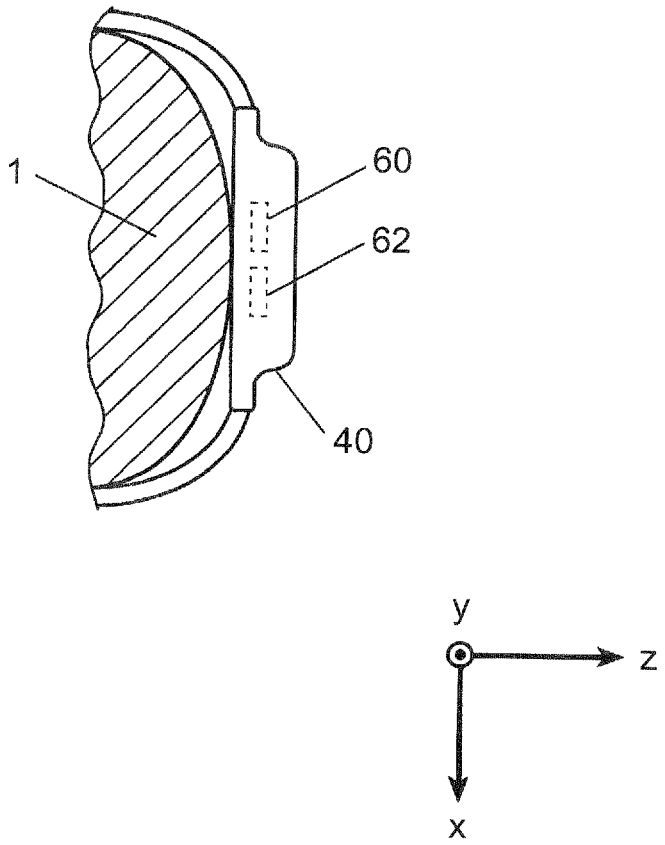
FIG. 5 is a view for explaining a tilt sensor 60 and an acceleration sensor 62 embedded in the electronic timepiece 40 on the user's arm according to the embodiment.

FIG. 3 illustrates the electronic timepiece 40 according to the embodiment of the present invention being connected with the smart phone 10 via wireless link. FIG. 4 illustrates the electronic timepiece 40 on a user's arm. FIG. 5 is a view for explaining the tilt sensor 60 and the acceleration sensor 62 embedded in the electronic timepiece 40 on the user's arm according to the embodiment.

As shown in FIG. 3, the electronic timepiece 40 has a function to perform near field communication through the Bluetooth®, and can perform data communication with the smart phone 10. The Bluetooth® module 48 of the electronic timepiece 40 is connected with the Bluetooth® module 22 of the smart phone 10 to perform data communication. The Bluetooth® module 48 includes an analog circuit, such as an RF chip (RF circuit), for transmitting/receiving wireless signals. Owing to the operating current for this analog circuit, the Bluetooth® module 48 consumes a relatively large amount of power. The Bluetooth® module 48 makes settings for communication in advance, which is called pairing. Thereby, the device information and data of an authentication key are exchanged between the electronic timepiece 40 and the smart phone 10 via wireless signals. Once the settings for communication are made, the setting process does not need to be performed every time. Depending on the environment or a user operation, the communication connection with the smart phone 10 is broken or established automatically or semi-automatically. For example, when the electronic timepiece 40 and the smart phone 10 are separated from each other by such a long distance that wireless signals cannot reach, the communication connection is broken; and when the electronic timepiece 40 and the smart phone 10 get so close to each other that the wireless signals can reach each other, the communication connection is automatically established or semi-automatically established in response to a user operation. Thus, as long as the smart phone 10 exists near the electronic timepiece 40, these two devices are constantly linked to each other.

A user can turn on or off the Bluetooth® function by operating a switch of the electronic timepiece 40. When the Bluetooth® function is turned off by operating the switch, the power of the Bluetooth® module is not turned off and time display does not disappear, although the connection is broken.

The electronic timepiece 40 has a power saving function. The power saving function turns off the power of the Bluetooth® module 48 of the electronic timepiece 40 and turns off the time display when the conditions described in detail later are fulfilled while the power saving function is set to an on-state. Even when the time display is turned off, the timekeeping function of the electronic timepiece 40 does not cease. When the power of the Bluetooth® module 48 is turned off, no current except a slight leakage current is consumed. On the other hand, when the power saving function is set to an off-state, the electronic timepiece 40 does not get into the power saving state, and therefore, the power of the Bluetooth® module 48 is in an on-state all day and night.

Next, operations of the tilt sensor 60 and the acceleration sensor 62 embedded in the electronic timepiece 40 are described. As shown in FIG. 4, a user wears the electronic timepiece 40 around his or her arm 1. It is assumed that the smart phone 10 (not illustrated) is in a bag of the user, for example. The user wearing the electronic timepiece 40 makes various movements including looking at the display of the electronic timepiece 40 and operating the switch unit 44. In making such movements, the user often rotates the arm 1 substantially around the axis of the arm 1, as shown in FIG. 4. In other words, the arm 1 rotates in the directions of six o'clock and twelve o'clock of the electronic timepiece 40. Hereinafter, the directions of six o'clock and twelve o'clock are referred to as a 6H direction. Further, the 6H direction is referred to as a longitudinal axis direction, and the direction perpendicular to the longitudinal axis direction is referred to as a lateral axis direction.

In view of such circumstances, the tilt sensor 60 which detects the tilting movement in the 6H direction is embedded in the main body of the electronic timepiece 40, as shown in FIG. 5, in the present embodiment. The tilt sensor 60 detects the tilting movement only uniaxially (longitudinal axis direction), i.e., the 6H direction, for example.

The tilt sensor 60 alone, however, would not be able to detect the movement of the electronic timepiece 40 which is almost at rest when the user crosses his or her arms in a meeting or on the train, or when the user is driving on an express highway, for example, resulting in activation of the power saving function. Accordingly, the acceleration sensor 62 is used in combination with the tilt sensor 60, as shown in FIG. 5. The acceleration sensor 62 detects movements in the z-axis direction, which is a direction perpendicular to the direction in which the tilt sensor 60 detects the tilting movement. In other words, the z-axis direction is a direction perpendicular to the glass surface (display panel) of the electronic timepiece 40, as shown in FIG. 4 and FIG. 5. The acceleration sensor 62 is a uniaxial detection type, for example, because power consumption for the biaxial detection type is about double the power consumption for the uniaxial detection type.

If the acceleration sensor 62 is at work for many hours, the battery 64*a* consumes a large amount of power. Accordingly, the power from the battery 64*a* is turned off except when the acceleration sensor 62 checks for accelerated movement.

Figure 6:
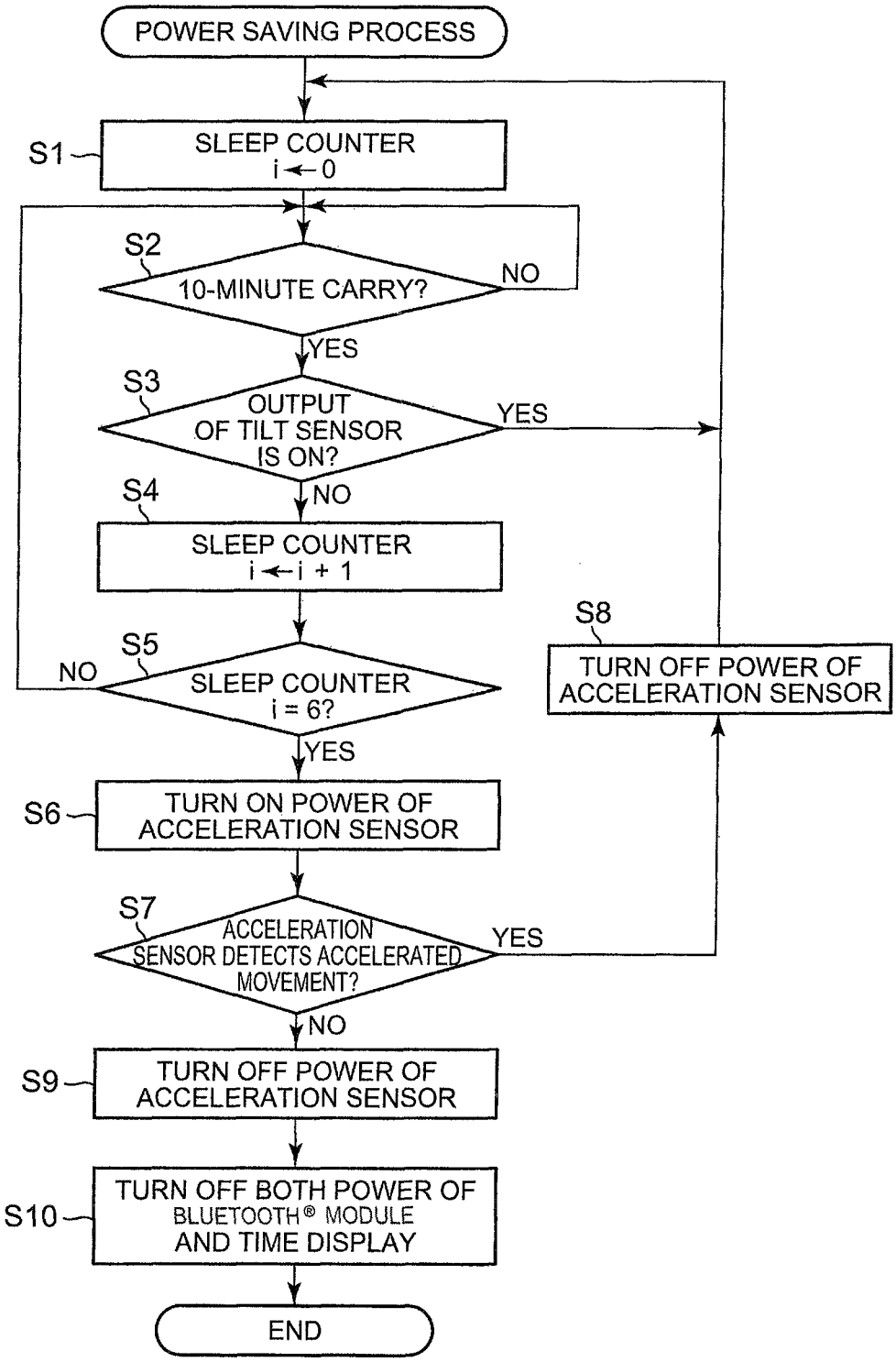
FIG. 6 is a flowchart illustrating a control procedure for a power saving process.

FIG. 6 is a flowchart illustrating a control procedure for a power saving process. The power saving process to be performed by the electronic timepiece 40 is described below with reference to the flowchart of FIG. 6.

When the power saving process starts, the CPU 41 sets the counter variable i of the sleep counter to zero (Step S1). Then, the CPU 41 determines whether the current time is a ten-minute carry. In other words, the CPU 41 determines whether the current time is zero minute, ten minutes, twenty minutes, thirty minutes, forty minutes, or fifty minutes past the hour (Step S2). If the current time is not ten-minute carry, the process branches to "NO", and the process of Step S2 is repeated. If the current time is ten-minute carry, the process branches to "YES" and goes on to Step S3. In Step S3, the CPU 41 determines whether an output of the tilt sensor 60 is ON. If the output of the tilt sensor 60 is not detected in Step S3, the process branches to "NO", and the CPU 41 increments the counter variable of the sleep counter by one (Step S4; i=1). Then, the process goes on to Step S5. If the output of the tilt sensor 60 is ON in Step S3, the process branches to "YES" and returns to Step S1, the beginning of the power saving process.

The CPU 41 determines whether the counter variable i of the sleep counter is six in Step S5. If the counter variable i is not six, the process branches to "NO" and goes back to Step S2. If the counter variable i of the sleep counter is six in Step S5, the process branches to "YES" and goes on to Step S6. The state in which the counter variable i is six means that the output of the tilt sensor 60 is not determined to be ON six times in a row in the measurement performed every ten minutes. The CPU 41, the tilt sensor 60, the detection circuit 61, and Steps S1 to S5 constitute a tilt detector.

In Step S6, the CPU 41 turns on the power of the acceleration sensor 62, and determines whether an accelerated movement is detected by the acceleration sensor 62 (Step S7). If the accelerated movement is not detected in Step S7, the process branches to "NO", and the power of the acceleration sensor 62 is turned off (Step S9). Further, the power of the Bluetooth® module 48 is turned off, and the time display is turned off (Step S10). Thus, the power saving process ends. On the other hand, if the accelerated movement is detected in Step S7, the power of the acceleration sensor 62 is turned off (Step S8), and the process returns to Step S1, the beginning of the power saving process. The CPU 41, the acceleration sensor 62, the detection circuit 63, and Step S7 constitute an acceleration detector. The CPU 41 and Step S10 constitute a power-off unit. The CPU 41 and Steps S6, S8, and S9 constitute an acceleration-sensor power controller.

As described above, the CPU 41 checks for a tilting movement of the timepiece main body using the tilt sensor 60 six times every ten minutes. If the tilting movement is not detected six times in a row, the CPU 41 turns on the power of the acceleration sensor 62 to detect the accelerated movement of the timepiece main body. If the accelerated movement is not detected, the CPU 41 turns off the power of the Bluetooth® module 48 and turns off the time display. Thereby, the power can be saved efficiently. Here, checking for the tilting movement of the timepiece main body using the tilt sensor 60 six times every ten minutes is referred to as "checking for the tilting movement of the timepiece main body within a predetermined period of time". In the present embodiment, the checking is performed six times every ten minutes. Alternatively, the checking may be performed twelve times every ten minutes, or six times every five minutes.

In the present embodiment, the power of the Bluetooth® module 48 and the time display are turned off at the same time in Step S10 of the power saving process. However, the turning off of the Bluetooth® module 48 power and the time display does not necessarily need to be performed at the same time. Alternatively, the time display may be turned off by the power-off unit when it is determined that the tilt sensor 60 does not detect the tilting movement a predetermined number of times (i.e., when the process branches to "YES" in Step S5), and then, the power of the Bluetooth® module may be turned off by the power-off unit in Step S10 when it is determined that the acceleration sensor 62 does not detect the accelerated movement.

Figure 7:
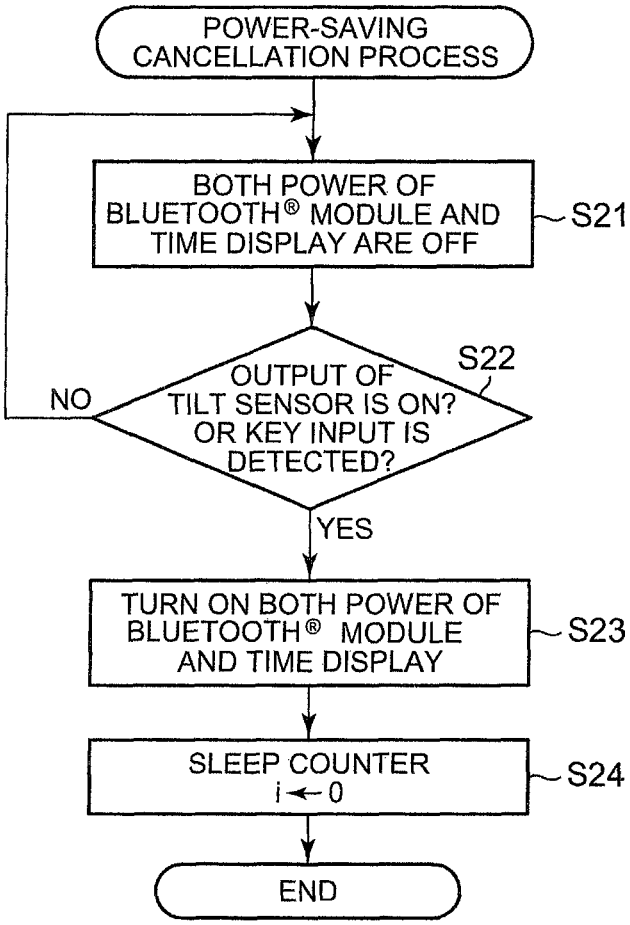
FIG. 7 is a flowchart illustrating a control procedure for a power-saving cancellation process to be performed when the electronic timepiece 40 is in a power-saving mode.

FIG. 7 is a flowchart illustrating a control procedure for a power-saving cancellation process to be performed when the electronic timepiece 40 is in the power-saving mode.

When the power-saving cancellation process starts, the CPU 41 checks that the power of the Bluetooth® module 48 is off, and that the time display is off (Step S21). Then, the CPU 41 determines whether a tilting movement of the timepiece main body is detected by the tilt sensor 60 or a key input operation (input operation through the switch unit 44) is performed by a user (Step S22). If it is determined that neither the tilting movement of the timepiece main body nor the key input is detected in Step S22, the process branches to "NO" and goes back to Step S21.

On the other hand, if it is determined that any one of the tilting movement of the timepiece main body and the key input is detected in Step S22, the process branches to "YES" in Step S22. Then, the CPU 41 turns on the power of the Bluetooth® module 48, and turns on the time display (Step S23). Then, the CPU 41 sets the counter variable i of the sleep counter to zero (Step S24). Thus, the power-saving cancellation process ends.

Thus, the power-saving cancellation process is triggered by the key input by a user or a tilting movement of the timepiece main body detected by the tilt sensor 60. For example, when a user puts on the electronic timepiece 40 after leaving the electronic timepiece 40 lying for a predetermined period of time, the tilt sensor 60 is activated and the power-saving mode is canceled to turn on the power of the Bluetooth® module and to turn on the time display. Then, the electronic timepiece 40 can establish communication connection with the smart phone 10.

As described above, when the movement of the timepiece main body is not detected by each of the tilt detector (the CPU 41, the tilt sensor 60, the detection circuit 61, and Steps S1 to S5) and the acceleration detector (the CPL 41, the acceleration sensor 62, the detection circuit 63, and Step S7) while the power of the Bluetooth® module 48 is in an on-state, the electronic timepiece 40 according to the present embodiment turns off the power of the Bluetooth® module 48. Accordingly, the electronic timepiece 40 can efficiently turn off the power of the Bluetooth® module 48, which consumes a large amount of current in performing near field communication, using Bluetooth®, with a cellular phone such as the smart phone 10.

Further, the acceleration detector checks for the accelerated movement of the timepiece main body when the tilt detector does not detect the tilting movement of the timepiece main body within a predetermined period of time. Accordingly, the checking by the acceleration detector is performed less frequently, which results in reducing power consumption in the entire timepiece 40.

Further, the power-off unit turns off the display on the display unit at the same time as the turning off of the power of the Bluetooth® module, which results in further reducing power consumption in the entire timepiece 40.

Further, the power-off unit turns off the display on the display unit when the tilt detector does not detect the tilting movement of the timepiece main body within a predetermined period of time, which results in further reducing power consumption in the entire timepiece 40.

Further, the acceleration detector includes the acceleration sensor 62, and the electronic timepiece 40 includes an acceleration-sensor power controller (the CPU 41 and Steps S6, S8, and S9) that turns off the power of the acceleration sensor 62 when the acceleration sensor 62 is not to check for the accelerated movement. This results in further reducing power consumption in the entire timepiece 40.

Further, the tilt detector detects the tilting movement of the timepiece main body in the direction of the longitudinal axis of the display panel of the electronic timepiece 40, while the acceleration detector detects the accelerated movement of the timepiece main body in the direction of an axis perpendicular to the surface of the display panel. This simplifies the structures of the tilt sensor 60 and the acceleration sensor 62, resulting in cost reduction.

The present invention is not limited to the above-mentioned embodiment, but may be modified in various ways. For example, the module of the Bluetooth® is taken as an example of the communication unit in the embodiment. Alternatively, various types of power-saving near field communication, such as Wibree and ZigBee®; or another near field communication of a unique standard may be employed.

The acceleration sensor 62 of the present embodiment checks for accelerated movement once, if the tilt sensor 60 does not detect the tilting movement of the timepiece main body within a predetermined period of time. Alternatively, the accelerated movement may be checked multiple times in a constant cycle (e.g., multiple times every one or two minutes), and the power of the Bluetooth® module may be turned off in the case where the accelerated movement is not detected. Further, in the present embodiment, the accelerated movement in the z-axis direction shown in FIG. 4 and FIG. 5 is detected by the acceleration sensor 62, which z-axis direction is perpendicular to the direction of the tilting movement to be detected by the tilt sensor 60. Alternatively, the accelerated movement in the y-axis direction, i.e., the three o'clock-nine o'clock direction, may be detected by the acceleration sensor 62. Further, in the present embodiment, the smart phone 10 is taken as an example of the external device with which the timepiece 40 performs the near field communication. Alternatively, an electronic device, such as a normal cellular phone or a personal data assistant (PDA) may be employed instead of the smart phone 10.

The entire disclosure of Japanese Patent Application No. 2011-194529 filed on Sep. 7, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An electronic timepiece comprising:

a display unit that displays information including information of time;

a communication unit that performs near field communication with an external device via an antenna;

a tilt detector configured to detect a tilting movement of a main body of the electronic timepiece;

a tilt detection determining unit that determines whether or not the tilting movement is detected by the tilt detector;

an acceleration detector configured to detect an accelerated movement of the main body of the electronic timepiece;

an acceleration detection determining unit that determines whether or not the accelerated movement is detected by the acceleration detector when the tilt detection determining unit determines that the tilt detector did not detect the tilting movement within a predetermined period of time; and a power-off unit that turns off a power of the communication unit when the acceleration detection determining unit determines that the acceleration detector did not detect the accelerated movement.

2. The electronic timepiece according to claim 1, wherein the power-off unit turns off a display on the display unit when the power-off unit turns off the power of the communication unit.

3. The electronic timepiece according to claim 1, wherein the power-off unit turns off a display on the display unit when the tilt detection determining unit determines that the tilt detector did not detect the tilting movement within the predetermined period of time.

4. The electronic timepiece according to claim 1, further comprising an acceleration-sensor power controller, wherein the acceleration detector includes an acceleration sensor, and wherein the acceleration-sensor power controller turns off a power of the acceleration sensor when the acceleration sensor is not to check for the accelerated movement.

5. The electronic timepiece according to claim 4, wherein the acceleration-sensor power controller turns off the power of the acceleration sensor during the predetermined period of time, and wherein when the tilt detection determining unit determines that the tilt detector did not detect the tilting movement within the predetermined period of time, the acceleration-sensor power controller turns on the power of the acceleration sensor and again turns off the power of the acceleration sensor after the acceleration detection determining unit has determined whether or not the accelerated movement is detected by the acceleration detector.

6. The electronic timepiece according to claim 1, wherein the tilt detector detects the tilting movement in a direction of a longitudinal axis of a display panel of the electronic timepiece, and the acceleration detector detects the accelerated movement in a direction of an axis perpendicular to a surface of the display panel.

7. The electronic timepiece according to claim 1, wherein the acceleration detector consumes a larger amount of power than the tilt detector.

8. The electronic timepiece according to claim 1, wherein when the tilt detection determining unit determines that the tilt detector did not detect the tilting movement within the predetermined period of time, the acceleration detection determining unit determines whether or not the accelerated movement is detected by the acceleration detector within another predetermined period of time.

9. The electronic timepiece according to claim 1, wherein after the power-off unit turns off the power of the communication unit and the display on the display unit, when the tilt detection determining unit determines that the tilt detector detected the tilting movement, the power-off unit turns back on the power of the communication unit and the display on the display unit.

10. The electronic timepiece according to claim 1, wherein the tilt detection determining unit periodically determines whether or not the tilt detector detects the tilting movement during the predetermined period of time.

* * * * *